US010820778B2

(12) United States Patent
Lee et al.

(10) Patent No.: US 10,820,778 B2
(45) Date of Patent: Nov. 3, 2020

(54) DISHWASHER

(71) Applicant: LG ELECTRONICS INC., Seoul (KR)

(72) Inventors: Sangsoo Lee, Seoul (KR); Donghwi Park, Seoul (KR)

(73) Assignee: LG Electronics Inc., Seoul (KR)

( * ) Notice: Subject to any disclaimer, the term of this patent is extended or adjusted under 35 U.S.C. 154(b) by 360 days.

(21) Appl. No.: 15/742,669

(22) PCT Filed: Jul. 14, 2016

(86) PCT No.: PCT/KR2016/007650
§ 371 (c)(1),
(2) Date: Jan. 8, 2018

(87) PCT Pub. No.: WO2017/014491
PCT Pub. Date: Jan. 26, 2017

(65) Prior Publication Data

US 2018/0206698 A1 Jul. 26, 2018

(30) Foreign Application Priority Data

Jul. 20, 2015 (KR) ..... 10-2015-0102345

(51) Int. Cl.
*A47L 15/00* (2006.01)
*A47L 15/42* (2006.01)

(52) U.S. Cl.
CPC ..... *A47L 15/4225* (2013.01); *A47L 15/4209* (2016.11)

(58) Field of Classification Search
CPC ..... A47L 15/00
See application file for complete search history.

(56) References Cited

U.S. PATENT DOCUMENTS 3,425,651 A 2/1969 Jenkins
2006/0219272 A1* 10/2006 Lee ..... A47L 15/4204 134/56 D

FOREIGN PATENT DOCUMENTS

CN 203400110 U 1/2014
CN 203953591 11/2014
(Continued)

OTHER PUBLICATIONS

International Search Report and Written Opinion in International Application No. PCT/KR2016/007650, dated Sep. 29, 2016, 10 pages.

(Continued)

*Primary Examiner* — Jason Y Ko
(74) *Attorney, Agent, or Firm* — Fish & Richardson P.C.

(57) ABSTRACT

Disclosed is a dishwasher (100) including a tub (11) configured to accommodate washing targets, spray arms (3, 5) provided within the tub (11) to spray washing water to the washing targets, a base (12) configured to support the tub (11), a sump (13) provided within the base (12) to store washing water, a pump (8) configured to supply washing water stored in the sump (13) to the spray arms (3, 5), a support body (91) fixed to the inside of the base (12) and located above the pump (8), at least two connection parts (95) configured to connect the pump (8) to the support body (91) and to damp vibration generated by the pump (8), and restriction parts (97) protruding from the base (12) to restrict the movement range of the pump (8) held by the connection parts (95).

15 Claims, 2 Drawing Sheets

(56) References Cited

FOREIGN PATENT DOCUMENTS

| | | | |
|---|---|---|---|
| DE | 1628488 | U | 4/1970 |
| DE | 3917349 | U | 1/1990 |
| EP | 2468171 | U | 6/2012 |
| WO | WO2000054392 | U | 9/2000 |

OTHER PUBLICATIONS

Extended European Search Report in European Appln. No. 16827995.
8, dated Jan. 28, 2019, 7 pages.

* cited by examiner

[Fig. 1]
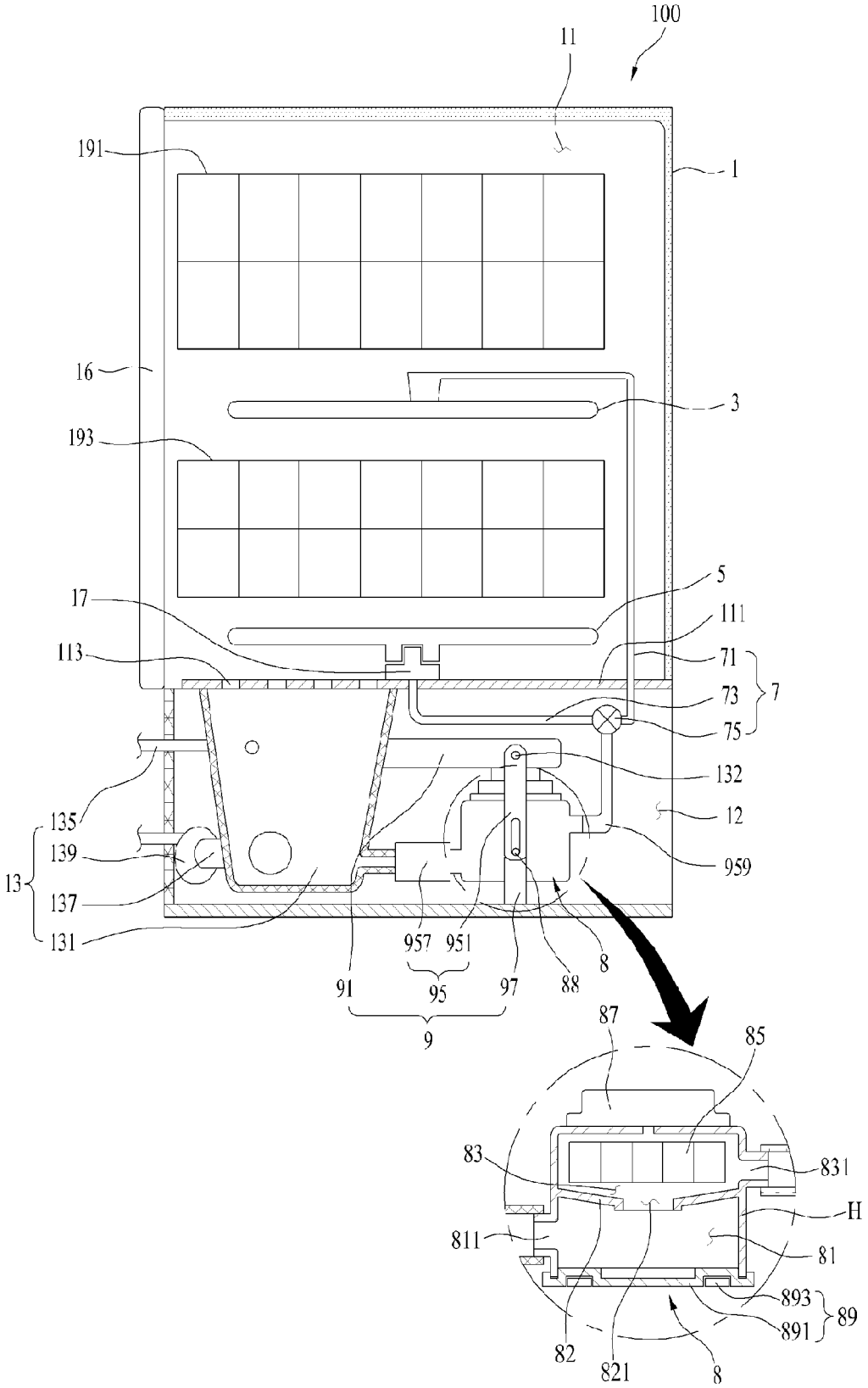

[Fig. 2]
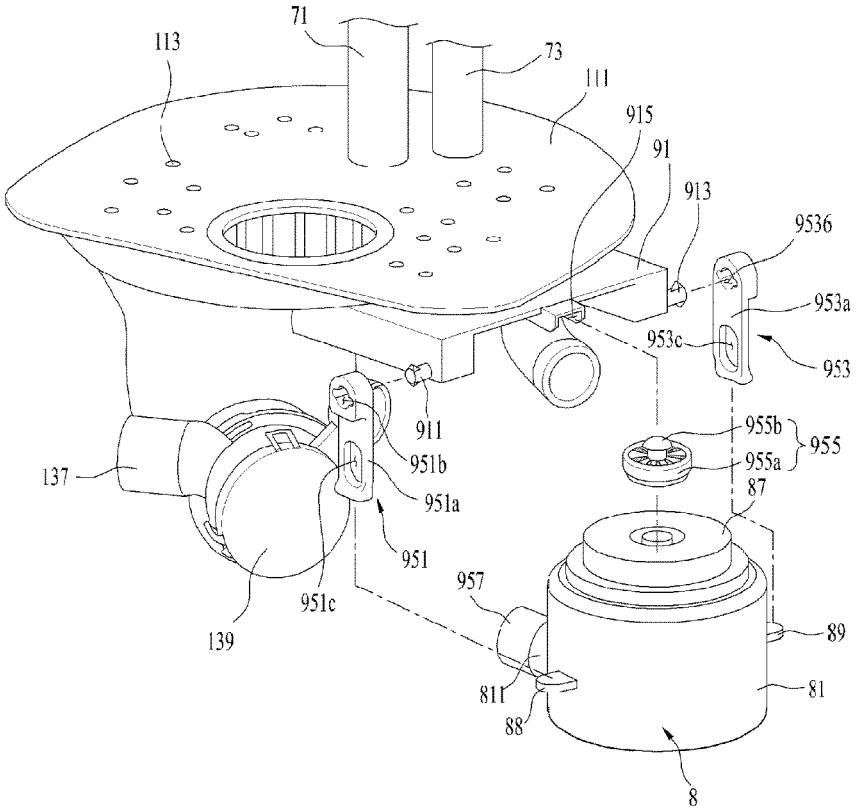
[Fig. 3]
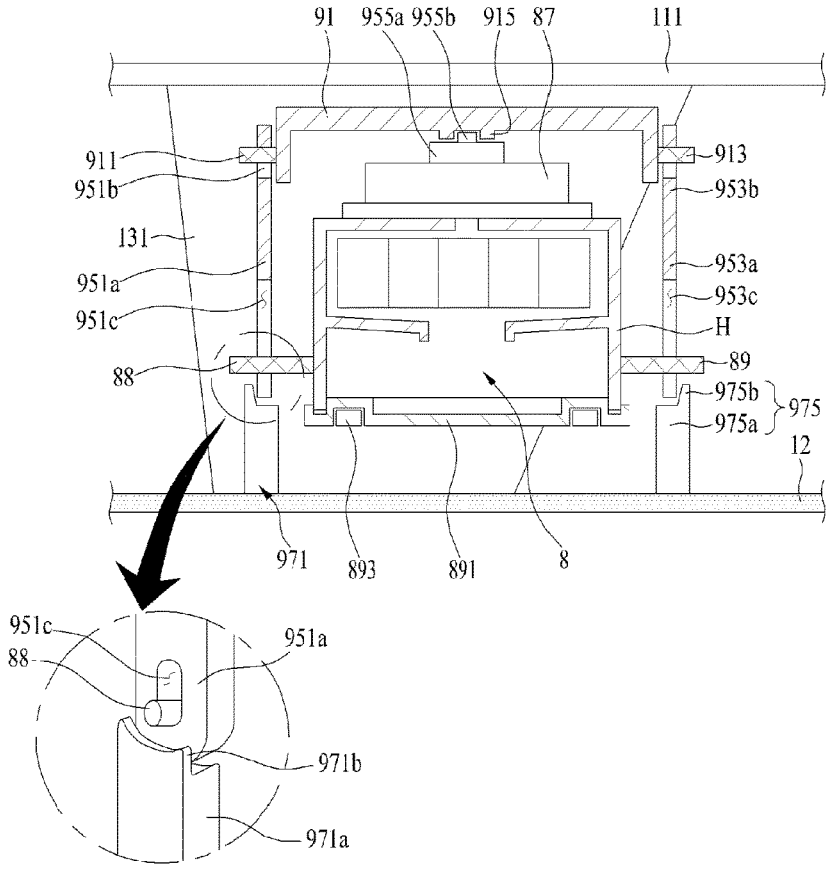

DISHWASHER

CROSS REFERENCE TO RELATED APPLICATIONS

This application is the National Phase of PCT International Application No. PCT/KR2016/007650, filed on Jul. 14, 2016, which claims priority under 35 U.S.C. 119(a) to Korean Patent Application No. 10-2015-0102345, filed on Jul. 20, 2015, which is hereby incorporated by reference herein in their entirety.

TECHNICAL FIELD

The present invention relates to a dishwasher, and more particularly, to a dishwasher having an improved pump fastening structure.

BACKGROUND ART

A dishwasher is an apparatus which washes dishes, cooking tools, etc. (hereinafter, referred to "washing targets") using detergent and washing water.

In general, a conventional dishwasher includes a tub to provide a washing space, racks provided within the tub to accommodate washing targets, spray arms to spray washing water to the racks, a sump to store washing water, and a pump to supply washing water stored in the sump to the spray arms.

The conventional dishwasher includes no device to intercept vibration generated by a pump and thus causes noise and vibration during a process of transmitting vibration generated by the pump to a cabinet or the tub.

DISCLOSURE OF INVENTION

Technical Problem

An object of the present invention devised to solve the problem lies in a dishwasher which may minimize transmission of vibration generated by a pump to a cabinet or a tub.

Solution to Problem

The object of the present invention can be achieved by providing a dishwasher includes a tub configured to accommodate washing targets, spray arms provided within the tub to spray washing water to the washing targets, a base configured to support the tub, a sump provided within the base to store washing water, a pump configured to supply washing water stored in the sump to the spray arms, a support body fixed to the inside of the base and located above the pump, at least two connection parts configured to connect the pump to the support body and to damp vibration generated by the pump, and restriction parts protruding from the base to restrict the movement range of the pump held by the connection parts.

The restriction parts may restrict at least one of movement of the pump in the vertical direction and movement of the pump in the horizontal direction.

The connection parts may include a first connection part and a second connection part connecting the pump to the support body so as to maintain the spaced state of the pump from the base by a designated distance, and the restriction parts may include a first restriction part fixed to the base to support the first connection part and a second retraction part fixed to the base to support the second connection part.

The first connection part and the second connection part may be formed of an elastic material.

The first restriction part may include a first body protruding from the base toward the first connection part, and a first stopper provided on the first body to restrict movement of the first connection part in the horizontal direction, and the second restriction part may include a second body protruding from the base toward the second connection part, and a second stopper provided on the second body to restrict movement of the second connection part in the horizontal direction.

A free terminal of the first body may be provided so as to contact the first connection part, and a free terminal of the second body may be provided so as to contact the second connection part.

The first restriction part may include a first body protruding from the base toward the first connection part and a first receipt groove provided on the first body to receive one end of the first connection part, and the second restriction part may include a second body protruding from the base toward the second connection part, and a second receipt groove provided on the second body to receive one end of the second connection part.

The pump may include a housing supported by the support body through the first connection part and the second connection part, a first chamber provided within the housing to communicate with the sump, a second chamber provided within the housing to communicate with the first chamber, and communicating with the spray arms, an impeller provided within the second chamber, a motor fixed to the outer surface of the housing and rotating the impeller, a heat transfer part detachably provided within the first chamber and forming the bottom surface of the first chamber, and a heating part fixed to the heat transfer part to heat the heat transfer part and located at the outside of the first chamber.

The connection parts may further include a third connection part located between the motor and the support body to damp vibration generated by the motor.

The support body may include a first coupling part coupled with the first connection part and a second coupling part coupled with the second connection part, the housing may include a first fastening part coupled with the first connection part and a second fastening part coupled with the second connection part, the first connection part may include a first connection body fixed to the first coupling part and a first connection body slit provided on the first connection body and combined with the first fastening part, and the second connection part may include a second connection body fixed to the second coupling part and a second connection body slit provided on the second connection body and combined with the second fastening part.

The first connection body slit may have a length, within which the first fastening part is movable in the height direction of the housing in the first connection body slit, and the second connection body slit may have a length, within which the second fastening part is movable in the height direction of the housing in the second connection body slit.

The dishwasher may further include a first connection body through hole provided on the first connection body and coupled with the first coupling part and a second connection body through hole provided on the second connection body and coupled with the second coupling part, the first connection body through hole may have a length, within which the first coupling part is movable in the height direction of the housing in the first connection body through hole, and the second connection body through hole may have a length, within which the second coupling part is movable in the height direction of the housing in the second connection body through hole.

Advantageous Effects of Invention

A dishwasher of the present invention may minimize transmission of vibration, generated by a pump, to a cabinet or a tub.

BRIEF DESCRIPTION OF DRAWINGS

FIG. 1 is a schematic view illustrating a dishwasher in accordance with one embodiment of the present invention.

FIG. 2 is an exploded perspective view illustrating a sump and a pump of the dishwasher in accordance with one embodiment of the present invention.

FIG. 3 is a cross-sectional view exemplarily illustrating a support unit in accordance with one embodiment of the present invention.

BEST MODE FOR CARRYING OUT THE INVENTION

Reference will now be made in detail to the preferred embodiments of the present invention, examples of which are illustrated in the accompanying drawings. A configuration or control method which will be described below is only to describe embodiments of the present invention but does not limit the scope of the invention. In the drawings, the same or similar elements are denoted by the same reference numerals even though they are depicted in different drawings.

As exemplarily shown in FIG. 1, a dishwasher 100 in accordance with the present invention includes a cabinet 1 forming the external appearance of the dishwasher 100, a tub 11 located within the cabinet 1 to provide a washing space, spray arms 3 and 5 provided within the tub 11 to spray washing water to washing targets, a sump 13 to store washing water, and a pump 8 to supply washing water stored in the sump 13 to the spray arms 3 and 5.

Racks 191 and 193 to accommodate washing targets may be provided within the tub 11. The racks 191 and 193 may include a first rack (an upper rack) 191 and a second rack (a lower tack) 193 located below the first rack 191.

A door 16 to open and close the tub 11 is provided on the cabinet 1, and the upper rack 191 and the lower rack 193 may be provided so as to be withdrawn from the cabinet 1 when the door 16 opens the tub 11.

That is, rails (not shown) to guide movement of the racks 191 and 193 toward the door 16 may be provided on the inner circumferential surface of the tub 11, and rollers (not shown) supported by the rails (not shown) may be provided on the racks 191 and 193.

The sump 13 may be located under the tub 11 and provided in a base 12 supporting the tub 11. The sump 13 may include a storage 131 to store washing water, a water supply path 135 to supply washing water to the storage 131, and a drain path 137 to discharge washing water stored in the storage 131 to the outside of the dishwasher 100.

The water supply path 135 may be provided to connect the storage 131 to a water supply source (not shown) and opened and closed by a water supply valve (not shown). A drain pump 139 may be provided on the drain path 137.

The sump 13 may recover washing water sprayed to the inside of the tub 11. That is, the storage 131 may be divided from the tub 11 by a diaphragm 111. In this case, recovery holes 113 to move washing water in the tub 11 to the storage 131 may be provided on the diaphragm 111.

The spray arms 3 and 5 may include a lower arm 5 provided within the tub 11 to wash washing targets accommodated in the lower rack 193, and an upper arm 3 provided within the tub 11 to wash washing targets accommodated in the upper rack 191.

The upper arm 3 and the lower arm 5 receive washing water from a pump 8 and supply paths 7. The supply paths 7 may include a first supply path 71 connected to the upper arm 3, a second supply path 73 connected to the lower arm 5, and a switching valve 75 to selectively open the respective supply paths 71 and 73.

If the lower arm 5 is provided within the tub 11 so as to be rotatable, the lower arm 5 may be combined with a holder 17 provided on a cover 15 so as to be rotatable and the second supply path 73 may be provided to supply washing water to the holder 17.

Further, if the upper arm 3 is provided within the tub 11 so as to be rotatable, the upper arm 3 may be combined with the first supply path 71 so as to be rotatable.

The pump 8 may include a housing H provided within the base 12, a first chamber 81 provided within the housing H and communicating with the sump 13, a second chamber 83 to communicate the first chamber 81 with the supply paths 7, an impeller 85 provided within the second chamber 83, and a motor 87 provided at the outside of the housing H to rotate the impeller 85.

The first chamber 81 and the second chamber 83 are divided from each other by a chamber diaphragm 82 dividing the inner space of the housing H but communicate with each other by a diaphragm through hole 821 passing through the chamber diaphragm 82.

The first chamber 81 receives washing water through an inlet 811, and the second chamber 83 discharges washing water through an outlet 831. In this case, the inlet 811 and the sump 13 may be connected through an inlet connection pipe (a fourth connection part) 957, and the outlet 831 and the switching valve 75 may be connected through an outlet connection pipe (a fifth connection part) 959.

Therefore, when power is supplied to the motor 87 and thus the impeller 85 is rotated, washing water stored in the sump 13 is introduced into the first chamber 81 and then flows to the second chamber 83. Washing water introduced into the second chamber 83 flows to the switching valve 75 through the outlet 831 and the outlet connection pipe 959, and washing water supplied to the switching valve 75 is supplied to the upper arm 3 or the lower arm 5 along the supply path 71 or 73 opened by the switching valve 75.

Further, a heater 89 to heat washing water may be provided within the first chamber 81. The heater 89 may include a heat transfer part 891 forming the bottom surface of the first chamber 81 and a heating part 893 to heat the heat transfer part 891.

The heat transfer part 891 may be detachably provided on the housing H. The heating part 893 may include a heating element which is located at the outside of the first chamber 81, fixed to the heat transfer part 891 and generates heat when current is supplied thereto.

In general, in a conventional dishwasher, a heater to heat washing water is located within a chamber to store washing water. In this case, in order to prevent the heater from overheating, a controller of the dishwasher needs to control the level of washing water in the chamber so that the heater is not exposed to the outside of washing water.

However, in the present invention, since the heat transfer part 891 (formed of a conductor) forms the entirety of the bottom surface of the first chamber 81 and is heated by the heating part 893 located at the outside of the first chamber 81, overheating of the heater 89 may be prevented even if the level of washing water in the first chamber 81 is not controlled.

The pump 8 having the above-described structure may be fixed to the inside of the base 12 through a support unit 9. The support unit 9 serves to prevent vibration generated by the pump 8 from being transmitted to the tub 11, the base 12 or the cabinet 1.

That is, the support unit 9 may include a support body 91 fixed to the inside of the base 12 and located above the pump 8, two connection parts 95 to connect the support body 91 to the pump 8 and to damp vibration generated by the pump 8, and restriction parts 97 provided on the base 12 to restrict the movement range of the pump 8 held by the connection parts 95.

As exemplarily shown in FIG. 2, the support body 91 may be fixed to any region as long as it may be located above the pump 8. That is, the support body 91 may be fixed to the base 12, the diaphragm 111 or the storage 131 and thus located above the pump 8, and FIG. 2 exemplarily illustrates that the support body 91 is fixed to the storage 131.

The connection parts 95 may include a first connection part 951 and a second connection part 952 to connect the pump 8 to the support body 91. In this case, the pump 8 may be suspended from the support body 91 by the first connection part 951 and the second connection part 953. That is, the bottom surface of the pump 8 maintains a designated separation distance with the base 12 by the first connection part 951 and the second connection part 953.

In order to minimize transmission of vibration generated by the pump 8 to the support body 91, the first connection part 951 and the second connection part 953 may be formed of a material which may absorb vibration (an elastic material, rubber, etc.).

The first connection part 951 may include a first connection body 951*a* formed of an elastic material, a first connection body through hole 951*b* provided on the first connection body 951*a* and combined with the support body 91, and a first connection body slit 951*c* provided on the first connection body 951*a* and combined with the housing H of the pump 8.

In this case, a first coupling part 911 inserted into the first connection body through hole 951*b* may be provided on the support body 91, and a first fastening part 88 inserted into the first connection body slit 951*c* may be provided on the housing H.

The second connection part 953 may have the same structure as the first connection part 951. That is, the second connection part 953 may include a second connection body 953*a* formed of an elastic material, a second connection body through hole 953*b* provided on the second connection body 953*a* and combined with the support body 91, and a second connection body slit 953*c* provided on the second connection body 953*a* and combined with the housing H of the pump 8.

In this case, a second coupling part 913 inserted into the second connection body through hole 953*b* may be provided on the support body 91, and a second fastening part 89 inserted into the second connection body slit 953*c* may be provided on the housing H.

The first connection body slit 951*c* may have a length, within which the first fastening part 88 is movable in the height direction of the housing H in the first connection body slit 951*c*, and the second connection body slit 953*c* may have a length, within which the second fastening part 89 is movable in the height direction of the housing H in the second connection body slit 953*c*.

The reason for this is not only to facilitate assembly of the respective fastening parts 88 and 89 and the respective connection parts 951 and 953 but also to consume vibration energy generated by the pump 8 during rotation of the motor 87 as kinetic energy required to move the pump 8 within the respective slits 951*c* and 953*c* so as to minimize transmission of vibration to the support body 91.

In order to maximize the above effects, the first connection body through hole 951*b* and the second connection body through hole 953*b* may be also provided as slits which are formed in the height direction of the housing H and have greater lengths than the diameters of the respective coupling parts 911 and 913.

In this case, the first connection body through hole 951*b* should have a length, within which the first coupling part 911 is movable in the height direction of the housing H in the first connection body through hole 951*b*, and the second connection body through hole 953*b* should have a length, within which the second coupling part 913 is movable in the height direction of the housing H in the second connection body through hole 953*b*.

The connection parts 95 may further include a third connection part 955 provided between the motor 87 and the support body 91 to prevent vibration of the motor 87 from being transmitted to the support body 91.

The first connection part 955 may include a third connection body 955*a* located between the motor 87 and the support body 91 and formed of an elastic material, and a body protrusion 955*b* protruding from the third connection body 955*a* and contacting the support body 91. In this case, a third coupling part 915, with which the body protrusion 955*b* is coupled, may be further provided on the support body 91.

Further, the body protrusion 955*b* may have a smaller cross-sectional area than the cross-sectional area of the third connection body 955*a*, and the body protrusion 955*b* may be a bar having a C-shaped cross-section and formed in the assembly direction of the pump 8. In this case, the body protrusion 955*b* serves not only to fix the third connection part 955 but also to determine the assembly position of the pump 8, i.e., to facilitate assembly of the pump 8.

The connection parts 95 in the present invention may further include a fourth connection part to prevent vibration generated by the pump 8 from being transmitted to the sump 13, and a fifth connection part to prevent vibration generated by the pump 8 from being transmitted to the supply paths 7.

The fourth connection part may be implemented by forming the inlet connection pipe 957 of an elastic material (rubber, etc.), and the fifth connection part may be implemented by forming the outlet connection pipe 959 of an elastic material.

Therefore, in the present invention, the connection parts 95 connecting the pump 8 to the sump 13, the supply paths 7 and the support body 91 are formed of an elastic material to damp vibration and may thus minimize transmission of vibration generated by the pump 8 to the tub 11 or the cabinet 1.

The pump 8 combined with the support body 91 by the connection parts 95 are suspended from the support body 91, thus being capable of swinging within the base 12 during operation of the motor 87.

When the pump 8 swings under the condition that the pump 9 is suspended from the support body 91, vibration of the pump 8 may be increased and the pump 9 may be separated from the connection parts 95. In order to solve such problems, the support unit 9 may further include the restriction parts 97 provided on the base 12 to restrict the movement range of the pump 8.

The restriction parts 97 are provided so as to restrict at least one of movement of the pump 8 in the vertical direction (in the height direction of the cabinet 1) and movement of the pump 8 in the horizontal direction (in the width direction of the cabinet 1). FIG. 3 exemplarily illustrates a case that the restriction parts 97 may restrict both movement of the pump 8 in the vertical direction and movement of the pump 8 in the horizontal direction.

As exemplarily shown in FIG. 3, the restriction parts 97 may include a first restriction part 971 provided on the base 12 to restrict the movement range of the first connection part 951, and a second restriction part 975 provided on the base 12 to restrict the movement range of the second connection part 953.

The first restriction part 971 may include a first body 971*a* protruding from the base 12 toward the first connection part 951, and a first stopper 971*b* provided on the first body 971*a* to restrict movement of the first connection body 951*a* in the horizontal direction.

The first body 971*a* may be provided so as to contact a free terminal of the first connection body 951*a* or to be spaced from the free terminal of the first connection body 951*a* by a designated distance. In any case, the first body 971*a* may restrict movement of the pump 8 in the vertical direction.

The second restriction part 975 may have the same structure as the first restriction part 971. That is, the second restriction part 9715 may include a second body 975*a* protruding from the base 12 toward the second connection body 953*a*, and a second stopper 975*b* provided on the second body 975*a* to restrict movement of the second connection body 953*a* in the horizontal direction.

The second body 975*a* may be provided so as to contact a free terminal of the second connection body 953*a* or to be spaced from the free terminal of the second connection body 953*a* by a designated distance.

Further, the first stopper 971*b* may be provided as a receipt groove (a first receipt groove) provided on the first body 971*a* to receive the free terminal of the first connection body 951*a*, and the second stopper 975*b* may be provided as a receipt groove (a second receipt groove) provided on the second body 975*a* to receive the free terminal of the second connection body 953*a*.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A dishwasher comprising:

a tub configured to accommodate washing targets;

spray arms provided within the tub to spray washing water to the washing targets;

a base configured to support the tub and comprising a top surface adjacent to the tub and a bottom surface opposite of the top surface;

a sump provided within the base to store washing water;

a pump configured to supply washing water stored in the sump to the spray arms;

a support body fixed to the inside of the base and located above the pump;

at least two connection parts configured to connect the pump to the support body and to damp vibration generated by the pump; and restriction parts protruding from the bottom surface of the base and configured to restrict a range of movement of the pump held by the connection parts, wherein the pump is suspended by the connection parts, and wherein the restriction parts are configured to restrict at least one of movement of the pump in the vertical direction or movement of the pump in the horizontal direction.

2. The dishwasher according to claim 1, wherein the connection parts include a first connection part and a second connection part connecting the pump to the support body so as to maintain the spaced state of the pump from the base by a designated distance.

3. The dishwasher according to claim 2, wherein the first connection part and the second connection part are formed of an elastic material.

4. The dishwasher according to claim 2, wherein the restriction parts include a first restriction part fixed to the base to support the first connection part and a second restriction part fixed to the base to support the second connection part.

5. The dishwasher according to claim 4, wherein:

the first restriction part includes a first body protruding from the base toward the first connection part, and a first stopper provided on the first body to restrict movement of the first connection part in the horizontal direction; and the second restriction part includes a second body protruding from the base toward the second connection part, and a second stopper provided on the second body to restrict movement of the second connection part in the horizontal direction.

6. The dishwasher according to claim 5, wherein:

a free terminal of the first body is provided so as to contact the first connection part; and a free terminal of the second body is provided so as to contact the second connection part.

7. The dishwasher according to claim 4, wherein:

the first restriction part includes a first body protruding from the base toward the first connection part, and a first receipt groove provided on the first body to receive one end of the first connection part; and the second restriction part includes a second body protruding from the base toward the second connection part, and a second receipt groove provided on the second body to receive one end of the second connection part.

8. The dishwasher according to claim 2, wherein the pump includes:

a housing supported by the support body through the first connection part and the second connection part;

a first chamber provided within the housing to communicate with the sump;

a second chamber provided within the housing to communicate with the first chamber, and communicating with the spray arms;

an impeller provided within the second chamber; and a motor fixed to an outer surface of the housing and rotating the impeller.

9. The dishwasher according to claim 8, wherein the pump further includes:

a heat transfer part detachably provided within the first chamber and forming a bottom surface of the first chamber; and a heating part fixed to the heat transfer part to heat the heat transfer part and located at the outside of the first chamber.

10. The dishwasher according to claim 8, wherein the connection parts further includes a third connection part located between the motor and the support body to damp vibration generated by the motor.

11. The dishwasher according to claim 8, wherein:

the support body includes a first coupling part coupled with the first connection part and a second coupling part coupled with the second connection part; and the housing includes a first fastening part coupled with the first connection part and a second fastening part coupled with the second connection part.

12. The dishwasher according to claim 11, wherein:

the first connection part includes a first connection body fixed to the first coupling part and a first connection body slit provided on the first connection body and combined with the first fastening part; and the second connection part includes a second connection body fixed to the second coupling part and a second connection body slit provided on the second connection body and combined with the second fastening part.

13. The dishwasher according to claim 12, wherein:

the first connection body slit has a length, within which the first fastening part is movable in the height direction of the housing in the first connection body slit; and the second connection body slit has a length, within which the second fastening part is movable in the height direction of the housing in the second connection body slit.

14. The dishwasher according to claim 12, further comprising:

a first connection body through hole provided on the first connection body and coupled with the first coupling part; and a second connection body through hole provided on the second connection body and coupled with the second coupling part.

15. The dishwasher according to claim 14, wherein:

the first connection body through hole has a length, within which the first coupling part is movable in the height direction of the housing in the first connection body through hole; and the second connection body through hole has a length, within which the second coupling part is movable in the height direction of the housing in the second connection body through hole.

* * * * *